US009803412B1

(12) United States Patent
Fontanini et al.

(10) Patent No.: US 9,803,412 B1
(45) Date of Patent: Oct. 31, 2017

(54) IN-VEHICLE CARBON MONOXIDE ALARM

(71) Applicants: Isabella D. Fontanini, Lake Bluff, IL (US); Kyle H. Wang, Lake Forest, IL (US); Kevin D. Kunz, Lake Forest, IL (US); Carlos W. von Borcke, Lake Forest, IL (US)

(72) Inventors: Isabella D. Fontanini, Lake Bluff, IL (US); Kyle H. Wang, Lake Forest, IL (US); Kevin D. Kunz, Lake Forest, IL (US); Carlos W. von Borcke, Lake Forest, IL (US)

( * ) Notice: Subject to any disclaimer, the term of this patent is extended or adjusted under 35 U.S.C. 154(b) by 0 days.

(21) Appl. No.: 15/164,359

(22) Filed: May 25, 2016

(51) Int. Cl.
*E05F 15/72* (2015.01)
*G07C 5/00* (2006.01)
*E05F 15/79* (2015.01)

(52) U.S. Cl.
CPC ..... *E05F 15/72* (2015.01); *E05F 15/79* (2015.01); *G07C 5/008* (2013.01); *E05Y 2900/106* (2013.01)

(58) Field of Classification Search
CPC ..... E05F 15/72; E05F 15/79; E05F 15/668; G07C 5/008; G07C 5/0816; E05Y 2900/106; E05Y 2800/42; E05Y 2400/52; E05Y 2400/30
See application file for complete search history.

(56) References Cited

U.S. PATENT DOCUMENTS 5,576,739 A * 11/1996 Murphy ..... F27D 19/00 340/3.4
6,208,256 B1 * 3/2001 Fleming ..... B60K 28/066 180/271
6,563,431 B1 * 5/2003 Miller, Jr. ..... E04H 6/426 340/330
7,103,460 B1 * 9/2006 Breed ..... B60C 23/0408 701/29.1
8,375,913 B2 * 2/2013 Kwiecinski ..... F02N 11/0807 123/179.2
8,669,878 B1 * 3/2014 Vantilburg ..... A62B 5/00 318/282
9,458,657 B2 * 10/2016 French ..... G08B 13/22
9,556,812 B2 * 1/2017 Ozkan ..... F02D 41/042
2001/0013762 A1 * 8/2001 Roman ..... E05F 15/70 318/282
2003/0102836 A1 * 6/2003 McCall ..... E05F 15/668 318/445
2006/0180371 A1 * 8/2006 Breed ..... G07C 5/008 180/197
2007/0046428 A1 * 3/2007 Mamaloukas ..... E05F 15/77 340/5.61

(Continued)

*Primary Examiner* — Justin Rephann
(74) *Attorney, Agent, or Firm* — Patti & Malvone Law Group, LLC

(57) ABSTRACT

A device and method for detecting operating conditions of a vehicle that could lead to toxic levels of carbon monoxide (CO) is disclosed. The device is inserted into an On-board Diagnostics (OBD-II) plug on a vehicle. It monitors operating conditions of the vehicle and detects situations that could lead to a toxic buildup of CO. If the situation where the engine running but the vehicle speed is not moving is detected, a signal is generated to cause a garage door to open. As an alternative, the method is accomplished in a processing device integral to the vehicle.

12 Claims, 3 Drawing Sheets

(56) References Cited

U.S. PATENT DOCUMENTS

| | | | | |
|---|---|---|---|---|
| 2010/0171588 | A1* | 7/2010 | Chutorash | G07C 9/00182 340/5.71 |
| 2012/0260575 | A1* | 10/2012 | Monaco | E05F 15/72 49/13 |
| 2013/0081329 | A1* | 4/2013 | French | G08B 13/22 49/13 |
| 2013/0201316 | A1* | 8/2013 | Binder | H04L 67/12 348/77 |
| 2014/0074383 | A1* | 3/2014 | Frey | G08B 21/14 701/110 |
| 2014/0309870 | A1* | 10/2014 | Ricci | H04W 48/04 701/36 |
| 2016/0053699 | A1* | 2/2016 | Ozkan | F02D 41/042 701/112 |
| 2016/0300415 | A1* | 10/2016 | Deneen | E05F 15/668 |
| 2017/0114585 | A1* | 4/2017 | Ozkan | E05F 15/72 |

* cited by examiner

IN-VEHICLE CARBON MONOXIDE ALARM

BACKGROUND

The invention relates generally to vehicle safety devices and more particularly to a device for protecting users from unsafe levels of carbon monoxide caused by vehicle operation in an enclosed space.

The dangers of carbon monoxide (CO) poisoning are well known. At high levels, carbon monoxide is toxic to humans. Many modern processes have the potential to produce lethal amounts of CO, and one of the most common places where carbon monoxide poisoning occurs is in the home, whether from a furnace or space heater malfunction, or from an unattended vehicle running in a closed garage.

CO is a gas that is odorless and colorless, therefore, it is difficult if not impossible for humans to detect that they are being poisoned, particularly while sleeping. For this reason, devices have been developed to monitor air quality and sound an alarm if a toxic level of CO is detected, similar to a smoke detector.

There are several types of sensors used in CO detectors. The simplest is a pad containing a chemical that changes color when exposed to CO. A biomimetic sensor operates similarly but uses chemicals that darken in proportion to the amount of CO in the environment, thus providing a more fine-tuned and reliable detection. An electrochemical sensor uses a fuel cell that generates a signal current related to the amount of CO in the atmosphere. Finally, a semiconductor sensor includes a sensing element that responds to CO in the atmosphere by changing its resistance, which can be monitored by an integrated circuit.

All of these sensors have downsides. The first three are chemical based, and therefore have a useful operational lifespan of approximately 5-7 years, sometimes much less. The semiconductor sensor must be heated to approximately 400° C., resulting in a large power demand and a useful lifespan of approximately 5-10 years. In addition, CO detectors are sensitive to their environment, and become less effective in environments experiencing temperature extremes, such as would exist in a garage, for example.

Thus, a need exists for a simple-to-use, reliable device that will protect against CO poisoning in a wide range of operating environments by detecting the root cause of the CO generation.

SUMMARY

The invention in one implementation encompasses a device and method for detecting operating conditions of a vehicle that could lead to toxic levels of carbon monoxide.

The apparatus according to an implementation of the invention includes a connector for inserting the device into the OBD-II plug of the vehicle and receiving data describing the operating condition of the vehicle and a body attached to the connector, said body enclosing at least a processor for receiving the data and detecting that the engine is running while the vehicle is not moving and generating a signal, a timer receiving the signal from the processor and starting a countdown period and a wireless interface for interacting with a garage door opener to open a garage door when the countdown period expires.

Another implementation of the invention encompasses a method for monitoring the operating conditions of a vehicle that could result in toxic levels of carbon monoxide (CO) including the steps of:

a) determining that the vehicle engine is running;

b) if so, determining whether or not the vehicle is moving;

c) if it is not moving, activating a timer;

d) determining whether or not the timer has expired;

e) if not, determining whether the vehicle speed is moving and if so, resetting the timer and returning to step a);

f) if so, determining whether the engine is not running and if so, returning to step a) otherwise returning to step d);

g) if the timer has expired, send a signal to a garage door opener requesting a communication session; and h) determining whether or not the garage door is open and if not, opening the garage door.

DESCRIPTION OF THE DRAWINGS

Features of example implementations of the invention will become apparent from the description, the claims, and the accompanying drawings in which:

DETAILED DESCRIPTION

The OBD-II (On-board diagnostics) system became mandatory equipment on all vehicles sold in the United States in 1996. An OBD-II plug provides access to an on-board computer that monitors and reports the status of various vehicle subsystems. Various tools can be attached to the OBD-II plug for the purposes of reading codes and data related to vehicle performance.

Figure 1:
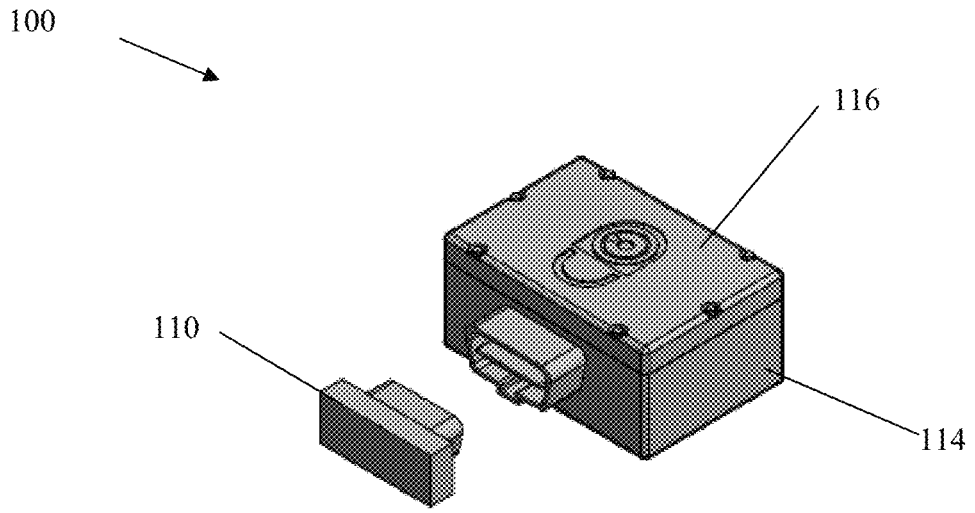
FIG. 1 depicts a device according to the present invention.

According to an embodiment as shown in FIG. 1, the invention encompasses a CO alarm device 100 that is inserted into an OBD-II plug 110 in a vehicle (not shown). CO alarm device 100 has a case body 114 and a cover 116, described in more detail below. Although a rectangular shape is shown, one of ordinary skill in the art would understand that CO alarm device 100 could have a variety of shapes and dimensions so as to be conveniently located in a vehicle. In an improvement over the prior art, the inventive CO alarm device does not rely on sensing CO in the atmosphere. Instead, the CO alarm device monitors the operating parameters of the vehicle and detects conditions that have the potential to lead to toxic levels of CO.

Figure 2:
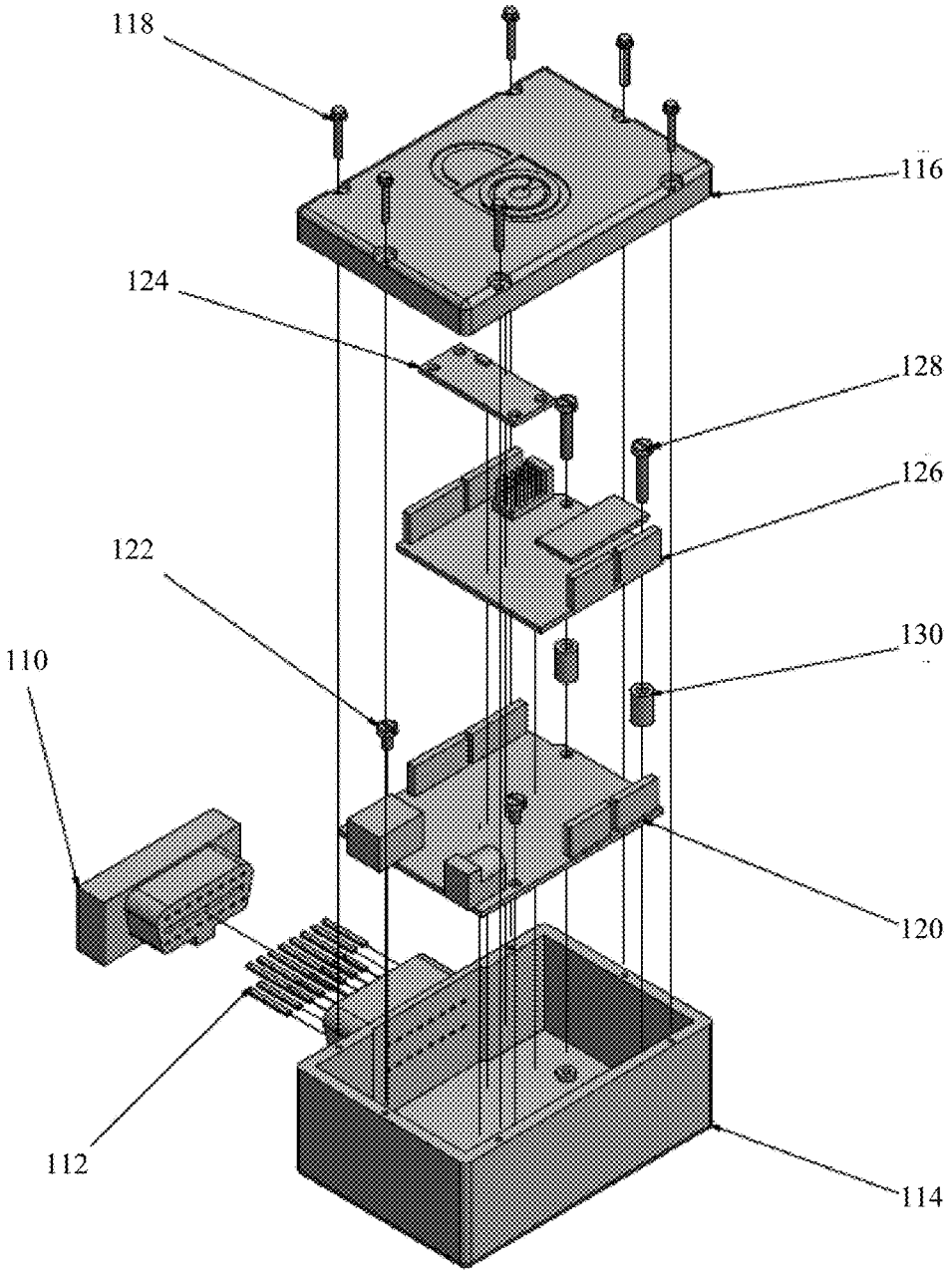
FIG. 2 depicts the device of FIG. 1 in exploded view.

As shown in FIG. 2, a CO alarm device 100 according to the invention is designed to be plugged into an OBD-II connector 110 located in a vehicle (not shown) by means of pins 112. A case body 114 contains components for accomplishing the invention. In an embodiment, a cover 116 is attached to case body 114 by means of screws 118, although one of ordinary skill in the art would understand that cover 116 could be attached to case body 114 by other means.

Components inside case body 114 include a microcontroller board 120 attached to case body 114 by means of screws 122. In an embodiment, microcontroller board 120 is an Arduino UNO® but any similar microcontroller board could be used, whether off-the-shelf or custom designed. A garage door opener circuit board 124 is attached to a communication interface board 126 for communicating with a garage door opener. In an embodiment, communication interface board 126 is an Arduino® SLAVE Bluetooth® Device, although other communication protocols could be used, for example, WiFi® or RF (radio frequency) signals. Communication interface board 126 is attached to microcontroller board 120 by means of screws 128 and spacers 130, although one of ordinary skill in the art would understand that alternative mechanisms could be used to for attachment.

Figure 3:
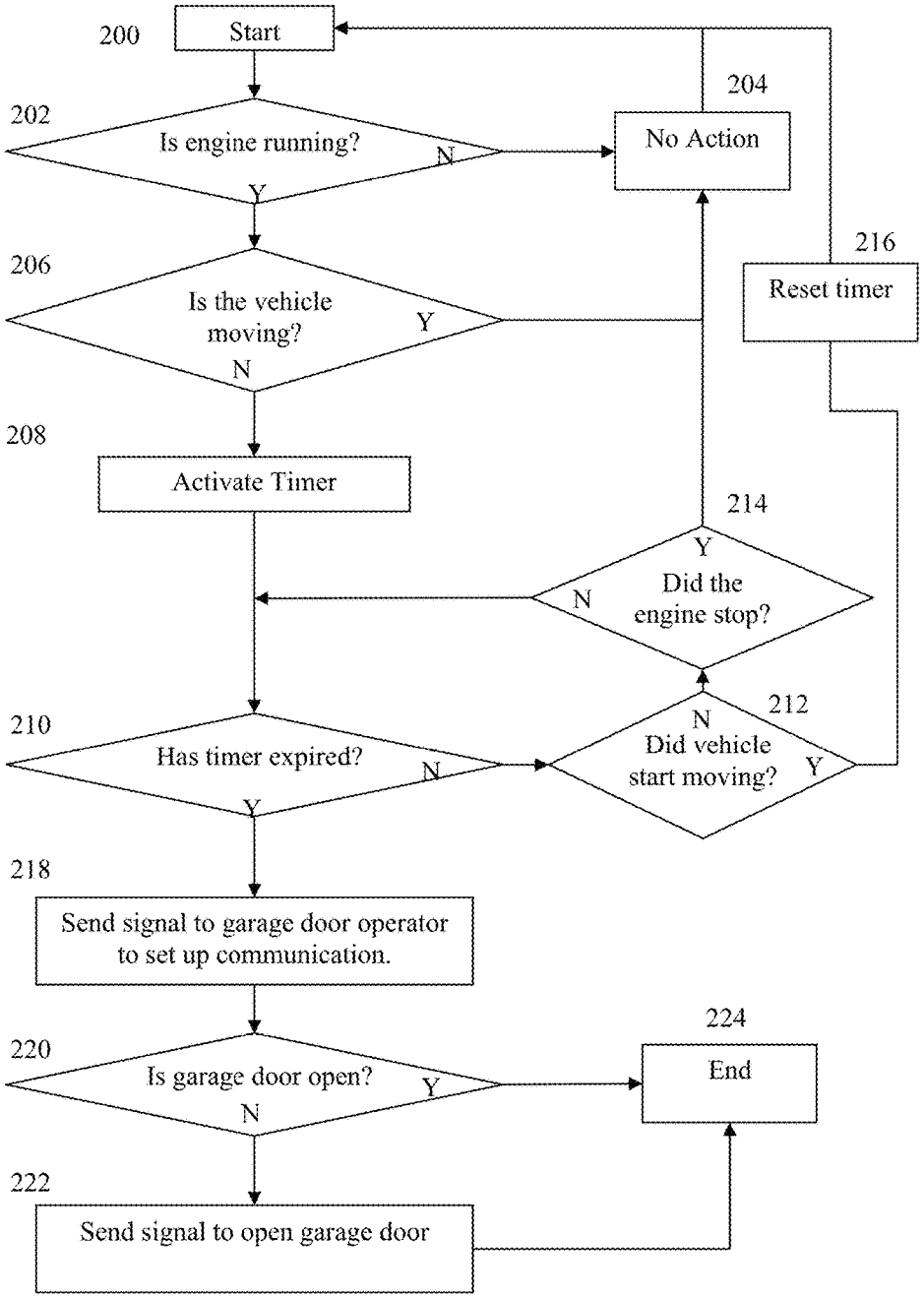
FIG. 3 is a flowchart illustrating a method performed by the device of FIG. 1.

A flowchart illustrating the operation of the CO alarm device 100 is shown in FIG. 3. Start block 200 indicates a waiting state where device 100 monitors the output of OBD-II connector 110 of FIG. 1 looking for appropriate codes. In step 202, device 100 detects if the vehicle is running. If not, no action is taken at 204. If the vehicle is running in step 202, the inventive method detects whether or not the vehicle is moving in step 206. This could be indicated by detecting vehicle speed=0, or detecting the transmission gear in Park, for example. If the vehicle is moving then this does not constitute a dangerous operating condition for the vehicle, no action is taken at 204 and the method returns to step 200 to monitor the output of OBD-II Connector 110. If the answer at decision block 204 is yes, indicating that the engine is running but the vehicle is in park or otherwise not moving, a timer is activated at step 208. In an embodiment, the timer is set for 15 minutes but a range of times could be used, for example, from 5 to approximately 30 minutes. The timer should be set for a time that is longer than the average stoplight or traffic stop, but shorter than the time required for an unsafe build-up of CO. One of ordinary skill in the art would understand that the timer could be incremented or decremented.

In step 210, device 100 detects whether or not the timer has expired. If the timer has not reached 15 minutes in step 210, at step 212 it is detected whether or not the vehicle is still not moving, as explained above. If the vehicle has started moving, it is assumed that the vehicle stopped for a reason other than parking in a garage, the timer is reset at step 216 and the method returns to block 200. If the vehicle is still not moving, the method checks to see if the engine has been turned off at step 214. If so, this indicates that a dangerous condition does not exist, no action is taken at step 204 and the method returns to block 200. However, if the result of decision block 214 is no, this indicates a condition where the vehicle is not moving but the engine is still running, so the method returns to step 210 and the timer continues to run.

After step 210, once the timer has expired, a signal is sent to the garage door operator in step 218. Communication with the garage door is performed wirelessly using, for example, a Bluetooth® protocol as explained above. In an alternative embodiment, step 218 could also be performed before the timer is activated.

In step 220, device 100 detects whether or not the garage door is open. If so, the process ends since the exhaust from the vehicle should be adequately vented. If the garage door is not open, the method proceeds to step 222, where a signal is sent to the operator to open the garage door, thereby preventing an unsafe condition.

In an embodiment, communication between device 100 and a garage door operator is limited to a certain distance, for example, less than 15 feet. This is to allow for situations where a vehicle operator may leave a vehicle temporarily running in a location that is not enclosed, for example, a driveway.

In a further embodiment, step 222 also includes the action of sending a message to a user's cell phone or similar device.

Although a standalone device for connecting to a vehicle's OBD-II connector has been disclosed, in an alternative embodiment, a method according to the present invention could also be incorporated within a processor on the vehicle itself.

The apparatus 100 in one example comprises a plurality of components such as one or more of electronic components, hardware components, and computer software components. A number of such components can be combined or divided in the apparatus 100. An example component of the apparatus 100 employs and/or comprises a set and/or series of computer instructions written in or implemented with any of a number of programming languages, as will be appreciated by those skilled in the art. The apparatus 100 in one example comprises any (e.g., horizontal, oblique, or vertical) orientation, with the description and figures herein illustrating one example orientation of the apparatus 100, for explanatory purposes.

The steps or operations described herein are just for example. There may be many variations to these steps or operations without departing from the spirit of the invention. For instance, the steps may be performed in a differing order, or steps may be added, deleted, or modified.

Although example implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. A device for monitoring an operating condition of a vehicle comprising an engine, the device comprising:

a connector for inserting the device into an onboard diagnostic (OBD-II) plug of the vehicle and receiving data describing the operating condition of the vehicle; and a body attached to the connector, said body enclosing at least:

a processor for receiving the data and detecting that the engine is running while the vehicle is not moving and generating a signal;

a timer for receiving the signal from the processor and starting a countdown period; and a wireless interface for interacting with a garage door opener to open a garage door when the countdown period expires.

2. The device of claim 1, wherein the wireless interface further comprises a transmitter and receiver for performing a communication according to a wireless LAN (local area network).

3. The device of claim 1, wherein the wireless interface further comprises a transmitter and receiver for performing a communication according to a short distance radio frequency protocol.

4. The device of claim 1, wherein the processor further comprises a microcontroller.

5. A method for monitoring the operating conditions of a vehicle comprising an engine and detecting toxic levels of carbon monoxide (CO), said method executed by a device operatively coupled to an onboard diagnostic (OBD-II) plug in the vehicle, the method comprising the steps of:

a) determining that the vehicle engine is running;

b) if so, determining whether or not the vehicle is moving;

c) if the vehicle is not moving, activating a timer;

d) determining whether or not the timer has expired;

e) if the timer has not expired, performing the steps of:

determining whether the vehicle is moving and if so, resetting the timer and returning to step a), and if the vehicle is not moving, determining whether the engine is not running and if so, returning to step a) otherwise returning to step d);

f) if the timer has expired, sending a signal to a garage door opener requesting a communication session; and g) determining whether or not the garage door is open and if not, opening the garage door.

6. The method of claim 5, wherein the timer is set for a period of at least 5 minutes but less than 30 minutes.

7. The method of claim 5, wherein step a) further comprises detecting an engine RPM is greater than 0.

8. The method of claim 5, wherein step b) further comprises detecting that the vehicle transmission is in Park.

9. The method of claim 5, wherein step b) further comprises detecting that vehicle speed is equal to 0.

10. The method of claim 5, wherein the communication session of step g) is conducted using a wireless LAN (local area network) protocol.

11. The method of claim 5, wherein the communication session of step g) is conducted using a short distance radio frequency protocol.

12. A device coupled to a vehicle comprising an engine for monitoring an operating condition of the vehicle resulting in toxic levels of carbon monoxide (CO), the device comprising:

a connector for inserting the device into an onboard diagnostic (OBD-II) plug of the vehicle and receiving data indicating if the engine of the vehicle is running and if the vehicle is moving; and a body attached to the connector, said body enclosing at least:

a processor for receiving the data and detecting that the engine is running while the vehicle is not moving and generating a signal;

a timer for receiving the signal from the processor, starting a countdown period, and sending a response to the processor when the countdown period expires; and a wireless interface for interacting with a garage door opener to open a garage door when the countdown period expires.

* * * * *